US009881546B2

(12) United States Patent
Peng

(10) Patent No.: US 9,881,546 B2
(45) Date of Patent: Jan. 30, 2018

(54) TWO-PIN LED PIXEL-CONTROLLED LIGHT STRING SYSTEM

(71) Applicant: Semisilicon Technology Corp., New Taipei (TW)

(72) Inventor: Wen-Chi Peng, New Taipei (TW)

(73) Assignee: Semisilicon Technology Corp., New Taipei (TW)

( * ) Notice: Subject to any disclaimer, the term of this patent is extended or adjusted under 35 U.S.C. 154(b) by 126 days.

(21) Appl. No.: 15/157,084

(22) Filed: May 17, 2016

(65) Prior Publication Data

US 2017/0337869 A1 Nov. 23, 2017

(51) Int. Cl.
*G09G 3/32* (2016.01)

(52) U.S. Cl.
CPC ..... *G09G 3/32* (2013.01); *G09G 2310/027* (2013.01)

(58) Field of Classification Search
CPC ..... G09G 3/32; G09G 2310/027
USPC ..... 345/82
See application file for complete search history.

(56) References Cited

U.S. PATENT DOCUMENTS

2005/0052373 A1* 3/2005 Devos ..... G06F 3/1446 345/82
2009/0021497 A1* 1/2009 Wendler ..... G06F 3/1446 345/204
2013/0249417 A1* 9/2013 Verlinden ..... H05B 33/0806 315/185 R

* cited by examiner

*Primary Examiner* — Jonathan Boyd
(74) *Attorney, Agent, or Firm* — Muncy, Geissler, Olds & Lowe, P.C.

(57) ABSTRACT

A two-pin LED pixel-controlled light string system includes a controller, data capture converters, power lines and two-pin LED pixel-controlled light string sets. The controller sends a picture signal to the data capture converters. Each of the number-setting circuits sets a number of the data capture converter. According to the number, the data capture converter captures a captured part of the picture signal. The data capture converter converts the captured part of the picture signal to obtain a light signal. The data capture converter sends the light signal through the power line to the two-pin LED pixel-controlled light string set that the two-pin LED pixel-controlled light string set is in accordance with and electrically connected to the data capture converter, to drive the two-pin LED pixel-controlled light string set to light. Each of the two-pin LED pixel-controlled light string sets lighting together forms a picture representing the picture signal.

11 Claims, 12 Drawing Sheets

TWO-PIN LED PIXEL-CONTROLLED LIGHT STRING SYSTEM

BACKGROUND OF THE INVENTION

Field of the Invention

The present invention relates to a light string system, and especially relates to a two-pin LED pixel-controlled light string system.

Description of the Related Art

The disadvantage of driving a plurality of related art two-pin LED pixel-controlled light emitting diode lamps is that each of the related art two-pin LED pixel-controlled light emitting diode lamps requires different address codes to be driven correctly, so that a lot of address codes of the related art two-pin LED pixel-controlled light emitting diode lamps are required. If the quantity of the related art two-pin LED pixel-controlled light emitting diode lamps is more, the quantity of the address codes is more, and manufacturing the related art two-pin LED pixel-controlled light emitting diode lamps is more complex, so that the related art two-pin LED pixel-controlled light emitting diode lamps are not manufactured easily.

SUMMARY OF THE INVENTION

In order to solve the above-mentioned problems, an object of the present invention is to provide a two-pin LED pixel-controlled light string system.

In order to achieve the object of the present invention mentioned above, the two-pin LED pixel-controlled light string system comprises a controller, a plurality of data capture converters, a plurality of power lines and a plurality of two-pin LED pixel-controlled light string sets. Each of the data capture converters is electrically connected to the controller respectively. The power lines are connected to the data capture converters. The two-pin LED pixel-controlled light string sets are connected to the power lines and are electrically connected to the data capture converter respectively. The data capture converter comprises a number-setting circuit. The controller sends a picture signal to the data capture converters. Each of the number-setting circuits is used to set a number of the data capture converter. According to the number, the data capture converter captures a captured part of the picture signal. The data capture converter converts the captured part of the picture signal to obtain a light signal. The data capture converter sends the light signal through the power line to the two-pin LED pixel-controlled light string set that the two-pin LED pixel-controlled light string set is in accordance with the data capture converter, to drive the two-pin LED pixel-controlled light string set to light. Each of the two-pin LED pixel-controlled light string sets lighting together forms a picture representing the picture signal.

The advantage of the present invention is that the two-pin LED pixel-controlled light emitting diode lamps of the two-pin LED pixel-controlled light string sets are manufactured easily (namely, the complexity is reduced). Moreover, the light signal is sent through the power line, so that the original control signal lines are not required, so that the lines are save.

DETAILED DESCRIPTION OF THE INVENTION

Please refer to following detailed description and figures for the technical content of the present invention. The following detailed description and figures are referred for the present invention, but the present invention is not limited to it.

Figure 1:
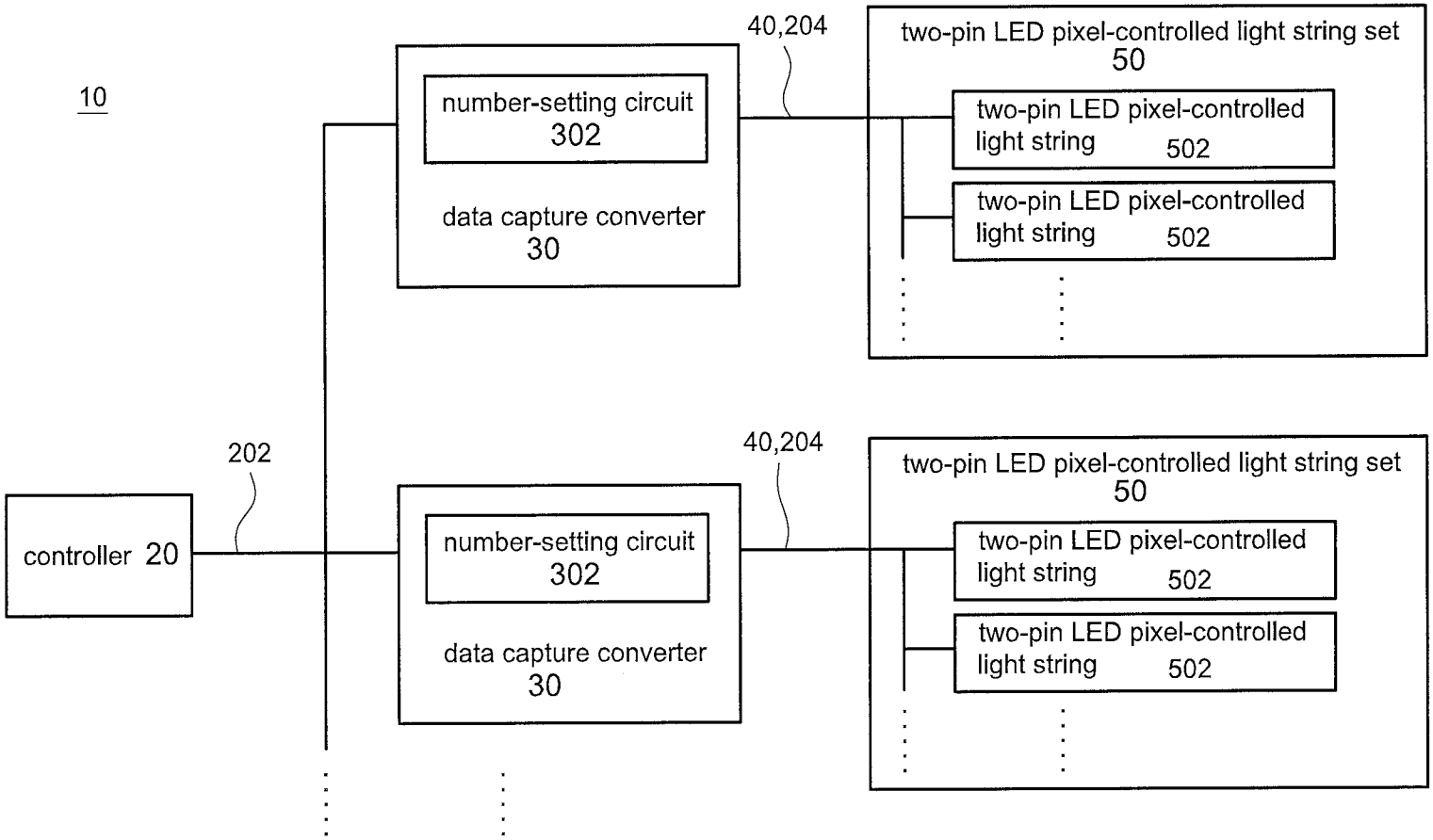
FIG. 1 shows a schematic block diagram of the two-pin LED pixel-controlled light string system of the present invention.

FIG. 1 shows a schematic block diagram of the two-pin LED pixel-controlled light string system of the present invention. A two-pin LED pixel-controlled light string system 10 comprises a controller 20, a plurality of data capture converters 30, a plurality of power lines 40 and a plurality of two-pin LED pixel-controlled light string sets 50. The data capture converter 30 comprises a number-setting circuit 302. The two-pin LED pixel-controlled light string set 50 comprises a plurality of two-pin LED pixel-controlled light strings 502. Each of the data capture converters 30 is electrically connected to the controller 20 respectively. The power lines 40 are connected to the data capture converters 30. The two-pin LED pixel-controlled light string sets 50 are connected to the power lines 40 and are electrically connected to the data capture converter 30 respectively. The two-pin LED pixel-controlled light strings 502 are electrically connected to the data capture converter 30 through the power line 40.

Figure 2:
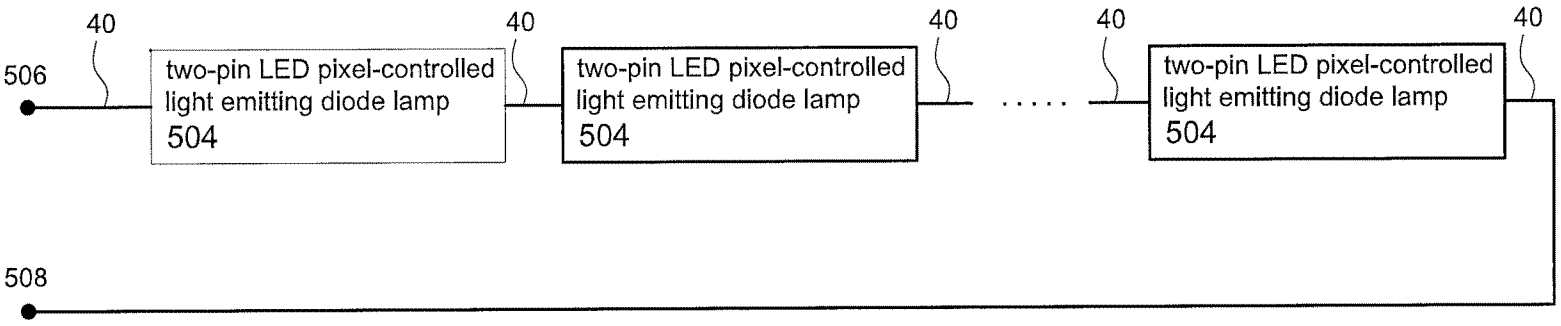
FIG. 2 shows a block diagram of the serial type two-pin LED pixel-controlled light string of the present invention.
Figure 3:
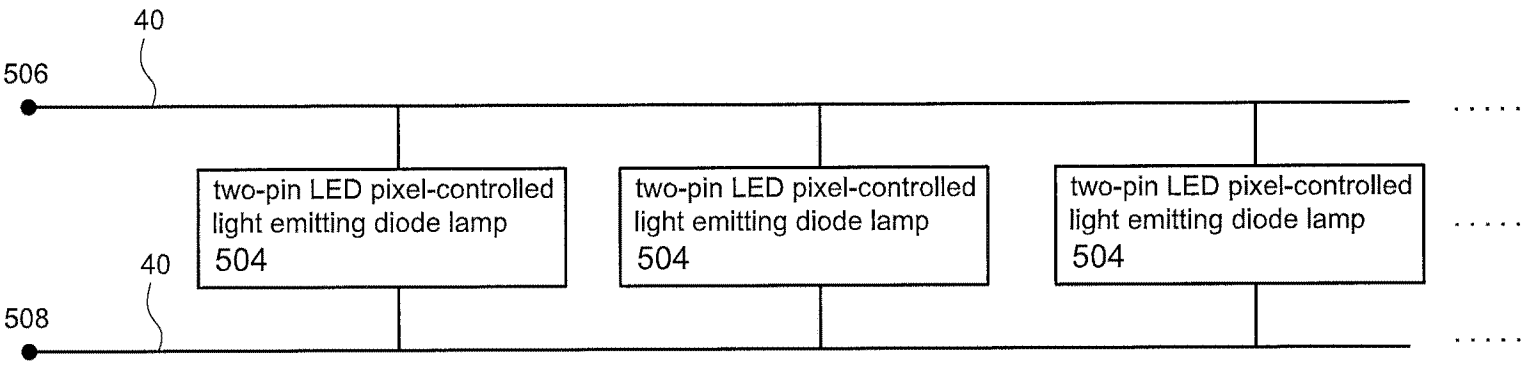
FIG. 3 shows a block diagram of the parallel type two-pin LED pixel-controlled light string of the present invention.

FIG. 2 shows a block diagram of the serial type two-pin LED pixel-controlled light string of the present invention. Please refer to FIG. 1 again. The two-pin LED pixel-controlled light string 502 comprises a plurality of two-pin LED pixel-controlled light emitting diode lamps 504, a light string input side 506 and a light string negative side 508. The two-pin LED pixel-controlled light emitting diode lamps 504 are electrically connected to the data capture converter 30 through the power line 40. FIG. 3 shows a block diagram of the parallel type two-pin LED pixel-controlled light string of the present invention. The description for the elements shown in FIG. 3, which are similar to those shown in FIG. 2, is not repeated here for brevity.

Figure 4:
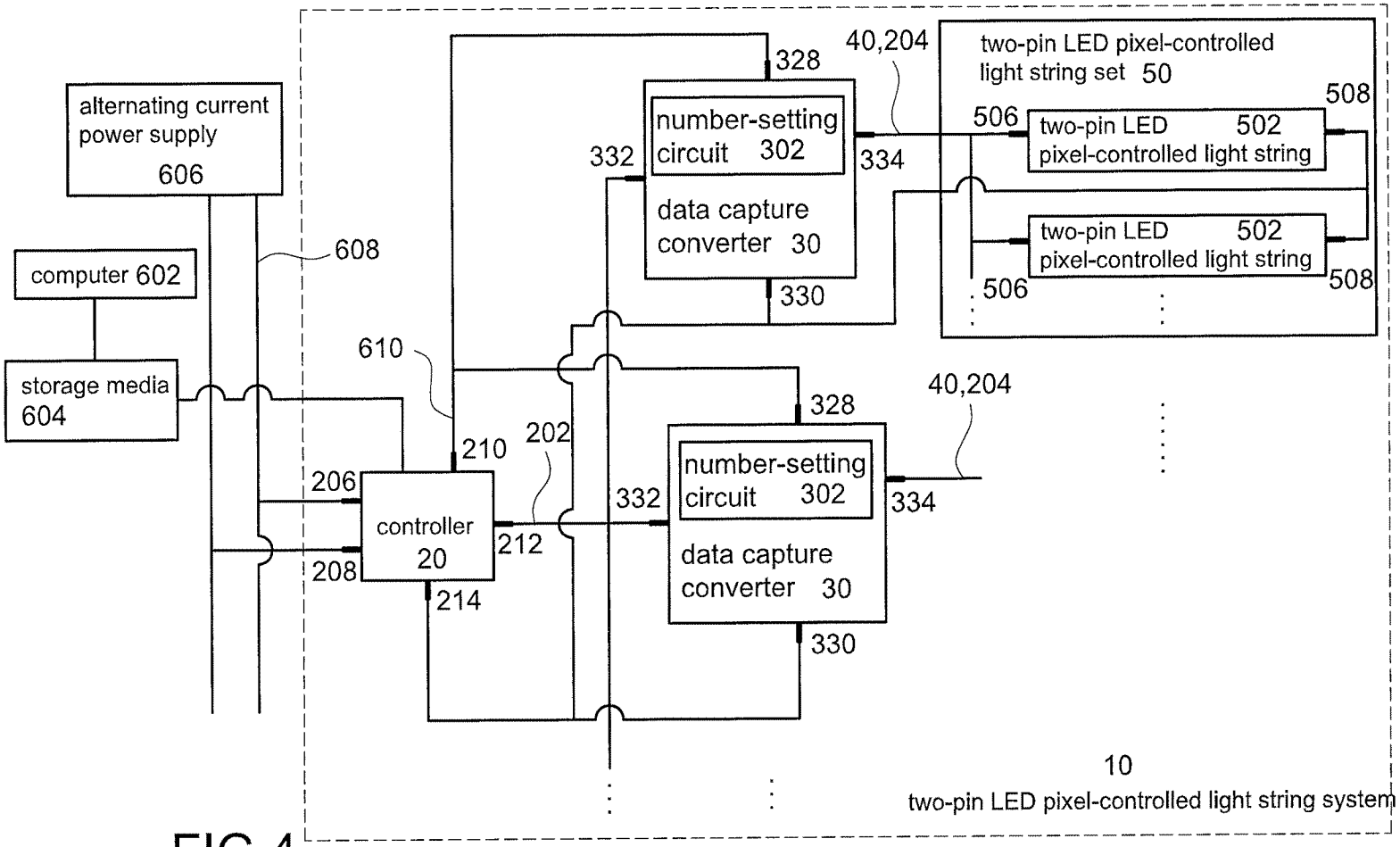
FIG. 4 shows a block diagram of the first embodiment of the serial type two-pin LED pixel-controlled light string system of the present invention.

FIG. 4 shows a block diagram of the first embodiment of the serial type two-pin LED pixel-controlled light string system of the present invention. The description for the elements shown in FIG. 4, which are similar to those shown in FIG. 1 and FIG. 2, is not repeated here for brevity. The two-pin LED pixel-controlled light string 502 of FIG. 4 is as shown in FIG. 2. The two-pin LED pixel-controlled light string system 10 is applied to a computer 602, a storage media 604 (for example, a memory card) and an alternating current power supply 606. The data capture converter 30 further comprises a converter voltage positive side 328, a converter voltage negative side 330, a converter data input side 332 and a converter output side 334. The controller 20 comprises an alternating current first endpoint 206, an alternating current second endpoint 208, a controller voltage positive side 210, a controller data output side 212 and a controller voltage negative side 214. The controller 20 can convert an alternating current power 608 provided by the alternating current power supply 606 into a direct current power 610. The computer 602 captures a film or an animation to store in the storage media 604. The controller 20 reads the film or the animation stored in the storage media 604 through, for example, a USB interface to convert the film or the animation into a picture signal 202.

Figure 5:
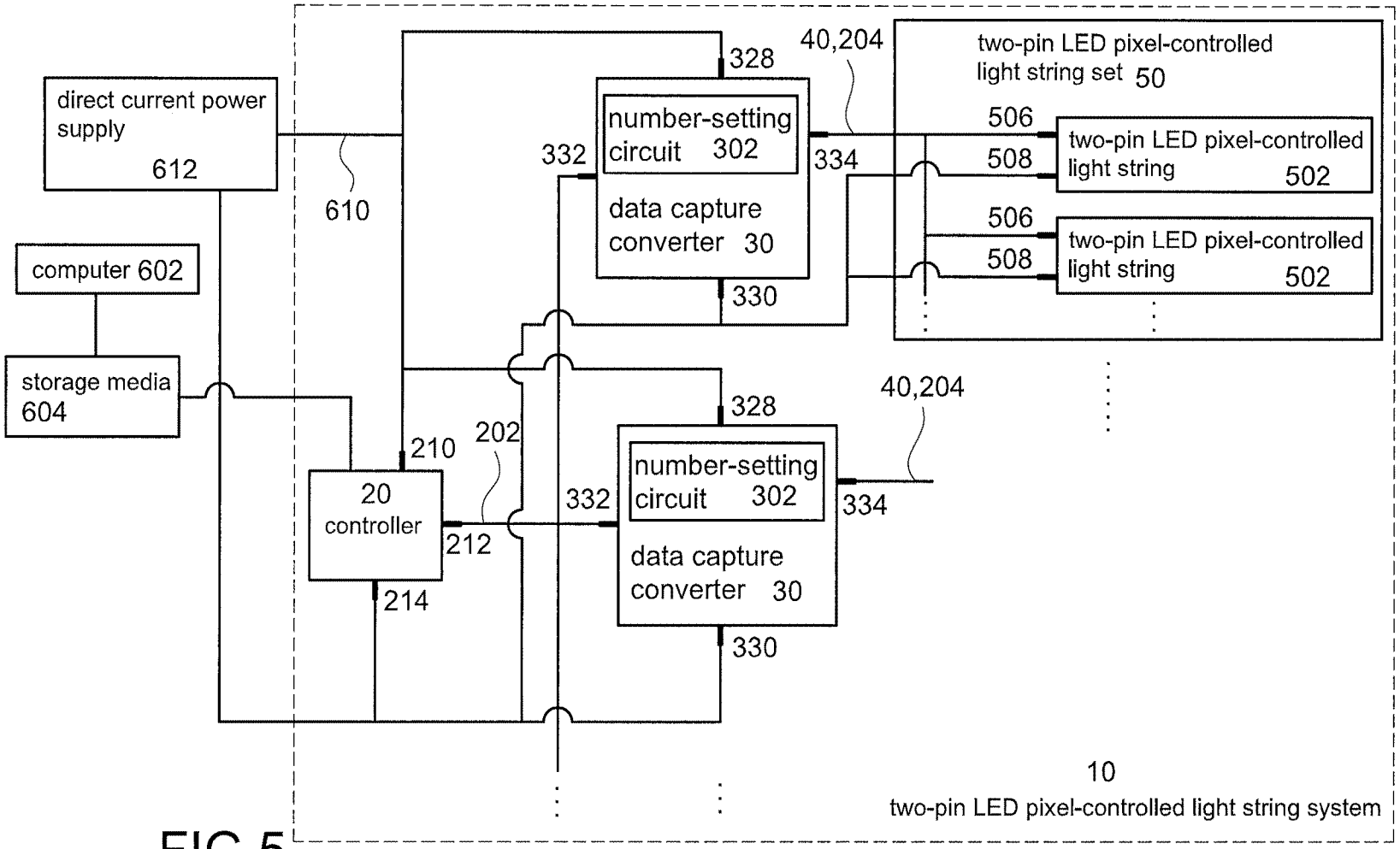
FIG. 5 shows a block diagram of the first embodiment of the parallel type two-pin LED pixel-controlled light string system of the present invention.

FIG. 5 shows a block diagram of the first embodiment of the parallel type two-pin LED pixel-controlled light string system of the present invention. The description for the elements shown in FIG. 4, which are similar to those shown in FIG. 1, FIG. 2, FIG. 3 and FIG. 4, is not repeated here for brevity. The two-pin LED pixel-controlled light string 502 of FIG. 5 is as shown in FIG. 3. The two-pin LED pixel-controlled light string system 10 is applied to a direct current power supply 612. The direct current power supply 612 provides a direct current power 610.

Figure 6:
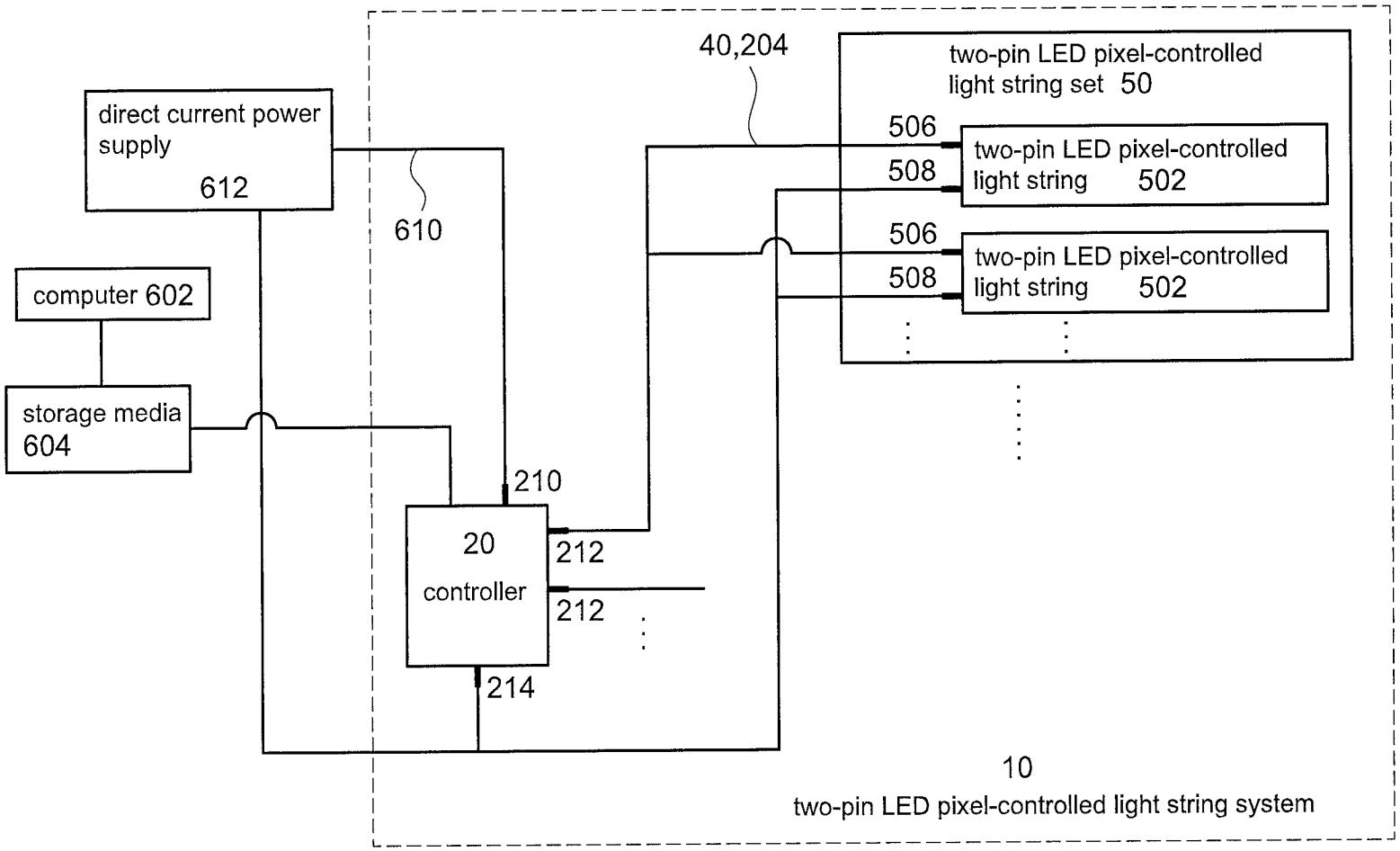
FIG. 6 shows a block diagram of the second embodiment of the parallel type two-pin LED pixel-controlled light string system of the present invention.

FIG. 6 shows a block diagram of the second embodiment of the parallel type two-pin LED pixel-controlled light string system of the present invention. The description for the elements shown in FIG. 6, which are similar to those shown in FIG. 5, is not repeated here for brevity. The two-pin LED pixel-controlled light string 502 of FIG. 6 is as shown in FIG. 3. The data capture converter 30 is integrated into the controller 20.

Figure 8:
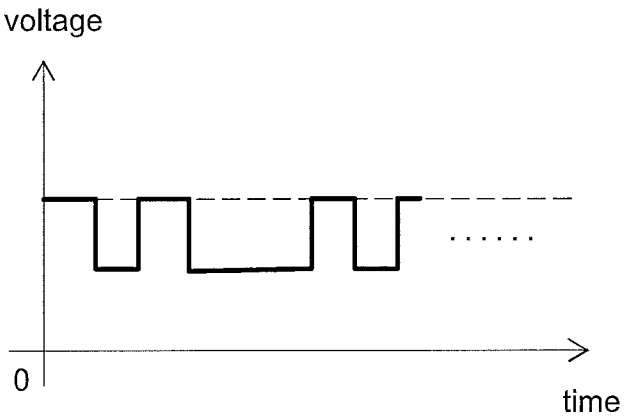
FIG. 8 shows a waveform diagram of an embodiment of the picture signal of the present invention.
Figure 7:
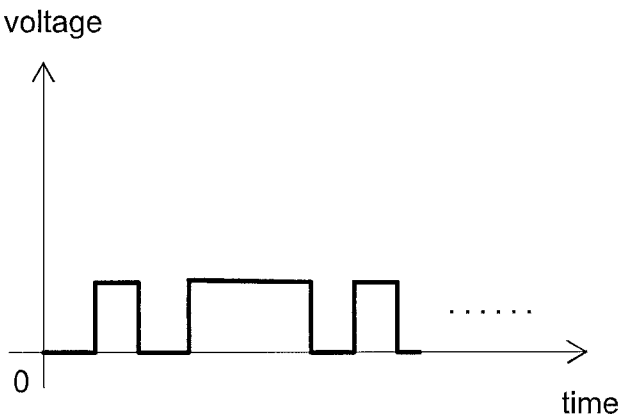
FIG. 7 shows a waveform diagram of an embodiment of the picture signal of the present invention.

FIG. 7 shows a waveform diagram of an embodiment of the picture signal of the present invention. FIG. 8 shows a waveform diagram of an embodiment of the picture signal of the present invention. Please refer to FIG. 1, FIG. 2, FIG. 3, FIG. 4, FIG. 5 and FIG. 6 at the same time.

Each of the number-setting circuits 302 is used to set a number of the data capture converter 30. The controller 20 sends the picture signal 202 to the data capture converters 30. According to the number, the data capture converter 30 captures a captured part of the picture signal 202 (namely, the captured part of the picture signal 202 is in accordance with the number of the data capture converter 30). The data capture converter 30 converts the captured part of the picture signal 202 to obtain a light signal 204. The data capture converter 30 sends the light signal 204 through the power line 40 to the two-pin LED pixel-controlled light string sets 50 to drive the two-pin LED pixel-controlled light string sets 50.

The two-pin LED pixel-controlled light emitting diode lamp 504 comprises an address code. The address codes of the two-pin LED pixel-controlled light emitting diode lamps 504 of the two-pin LED pixel-controlled light string set 50 are different. The address codes of the two-pin LED pixel-controlled light emitting diode lamps 504 of the two-pin LED pixel-controlled light string set 50 form an address code group. Each of the two-pin LED pixel-controlled light string sets 50 comprises the same address code group. The light signal 204 comprises a plurality of signals with different address codes.

The data capture converter 30 sends the light signal 204 through the power line 40 to the two-pin LED pixel-controlled light emitting diode lamps 504 of the two-pin LED pixel-controlled light strings 502 of the two-pin LED pixel-controlled light string set 50 that the two-pin LED pixel-controlled light string set 50 is in accordance with and electrically connected to the data capture converter 30, to drive the two-pin LED pixel-controlled light emitting diode lamps 504 of the two-pin LED pixel-controlled light strings 502 of the two-pin LED pixel-controlled light string set 50 to light. The two-pin LED pixel-controlled light emitting diode lamp 504 reads the light signal 204 according to the address code that the two-pin LED pixel-controlled light emitting diode lamp 504 has, and then the two-pin LED pixel-controlled light emitting diode lamp 504 lights accordingly. The two-pin LED pixel-controlled light emitting diode lamps 504 of the two-pin LED pixel-controlled light strings 502 of the two-pin LED pixel-controlled light string sets 50 lighting together form a picture representing the picture signal 202.

In an embodiment, the numbers of the data capture converters 30 are set as 1~n in order. The n is a positive integer greater than 1. The data capture converters 30 having a number m captures an m-part of the picture signal 202 to obtain the captured part. The m is greater than or equal to the n. The data capture converters 30 having the number m re-numbers the m-part of the picture signal 202 as 1~q to obtain the light signal 204. The q is equal to a quantity of the two-pin LED pixel-controlled light emitting diode lamps 504 of the two-pin LED pixel-controlled light string set 50. The address codes of the two-pin LED pixel-controlled light emitting diode lamps 504 of the two-pin LED pixel-controlled light string set 50 are set as 1~q in order. The two-pin LED pixel-controlled light emitting diode lamp 504 having an address code p is driven with a p-part of the light signal 204. The p is greater than or equal to 1. The p is less than or equal to q.

For example, the picture signal 202 comprises light data 1~2000 to control 2000 of the two-pin LED pixel-controlled light emitting diode lamps 504. The numbers of the data capture converters 30 are set as 1~10 in order. The data capture converters 30 having a number 1 captures a 1st-part (1~200) of the picture signal 202 to obtain the captured part. The data capture converters 30 having the number 1 re-numbers the 1st-part of the picture signal 202 as 1~200 to obtain the light signal 204. The address codes of the two-pin LED pixel-controlled light emitting diode lamps 504 of the two-pin LED pixel-controlled light string set 50 are set as 1~200 in order. The two-pin LED pixel-controlled light emitting diode lamp 504 having an address code 10 is driven with a 10th-part of the light signal 204.

For another example, the picture signal 202 comprises light data 1~2000 to control 2000 of the two-pin LED pixel-controlled light emitting diode lamps 504. The numbers of the data capture converters 30 are set as 1~10 in order. The data capture converters 30 having a number 2 captures a 2nd-part (201~400) of the picture signal 202 to obtain the captured part. The data capture converters 30 having the number 2 re-numbers the 2nd-part of the picture signal 202 as 1~200 to obtain the light signal 204. The address codes of the two-pin LED pixel-controlled light emitting diode lamps 504 of the two-pin LED pixel-controlled light string set 50 are set as 1~200 in order. The two-pin LED pixel-controlled light emitting diode lamp 504 having an address code 10 is driven with a 10th-part of the light signal 204.

For still another example, the picture signal 202 comprises light data 1~2000 to control 2000 of the two-pin LED pixel-controlled light emitting diode lamps 504. The numbers of the data capture converters 30 are set as 1~10 in order. The data capture converters 30 having a number 3 captures a 3rd-part (401~600) of the picture signal 202 to obtain the captured part. The data capture converters 30 having the number 3 re-numbers the 3rd-part of the picture signal 202 as 1~200 to obtain the light signal 204. The address codes of the two-pin LED pixel-controlled light emitting diode lamps 504 of the two-pin LED pixel-controlled light string set 50 are set as 1~200 in order. The two-pin LED pixel-controlled light emitting diode lamp 504 having an address code 10 is driven with a 10th-part of the light signal 204.

Therefore, the advantage of the present invention is that the two-pin LED pixel-controlled light emitting diode lamps 504 are manufactured easily (namely, the complexity is reduced) because the present invention does not require a lot of address codes of the two-pin LED pixel-controlled light emitting diode lamps 504. Taking the content mentioned above as an example, 2000 of the two-pin LED pixel-controlled light emitting diode lamps 504 does not require 2000 of the address codes. Utilizing the data capture converters 30, 2000 of the two-pin LED pixel-controlled light emitting diode lamps 504 require only 200 of the address codes. Moreover, the light signal 204 is sent through the power line 40, so that the original control signal lines are not required, so that the lines are save.

The picture signal 202 comprises a plurality of pulse waves. The data capture converter 30 counts the pulse waves of the picture signal 202 received by the data capture converter 30. According to the number, the data capture converter 30 captures the captured part of the picture signal 202, wherein the captured part is captured according to the number and a counting value.

For example, the picture signal 202 comprises 2000 of the pulse waves. The number of the data capture converter 30 is 2. Then, the data capture converter 30 counts (skips) the pulse waves 1~200, and then the data capture converter 30 captures the pulse waves 201~400.

Figure 9:
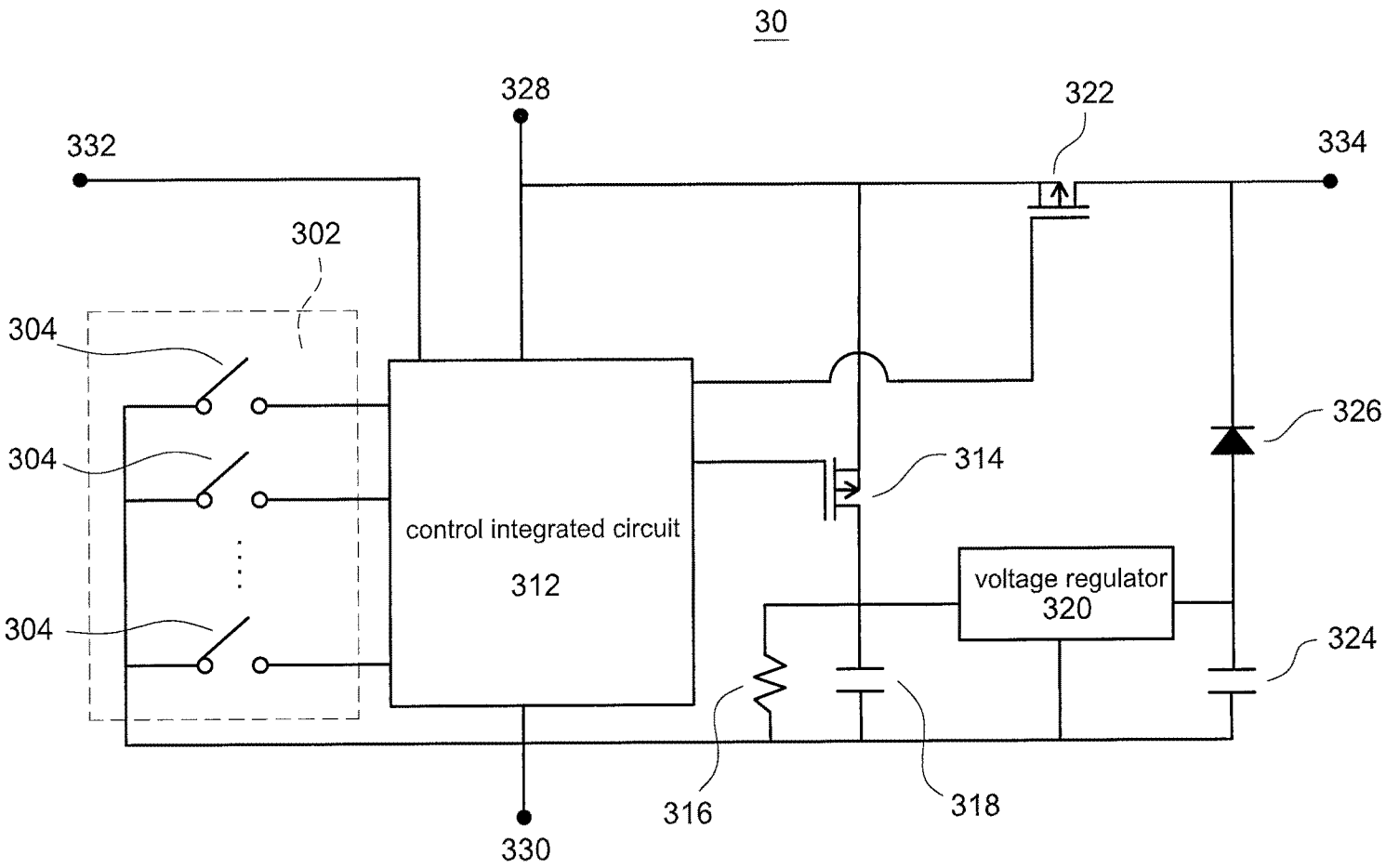
FIG. 9 shows a block diagram of the first embodiment of the parallel type data capture converter of the present invention.

FIG. 9 shows a block diagram of the first embodiment of the parallel type data capture converter of the present invention. FIG. 9 is applied to FIG. 3 and FIG. 5 (parallel type; the two-pin LED pixel-controlled light emitting diode lamps 504 are connected to each other in parallel through the power line 40). The number-setting circuit 302 comprises a plurality of switches 304. The number of the data capture converter 30 is determined by a status of the switches 304.

The data capture converter 30 further comprises a control integrated circuit 312, a first transistor switch 314, a first resistor 316, a first capacitor 318, a voltage regulator 320, a second transistor switch 322, a second capacitor 324 and a diode 326. The control integrated circuit 312 is used to receive the picture signal 202 and generate the light signal 204.

The control integrated circuit 312 is electrically connected to the number-setting circuit 302. The first transistor switch 314 is electrically connected to the control integrated circuit 312. The first resistor 316 is electrically connected to the number-setting circuit 302, the control integrated circuit 312 and the first transistor switch 314. The first capacitor 318 is electrically connected to the number-setting circuit 302, the control integrated circuit 312, the first transistor switch 314 and the first resistor 316. The voltage regulator 320 is electrically connected to the number-setting circuit 302, the control integrated circuit 312, the first transistor switch 314, the first resistor 316 and the first capacitor 318. The second transistor switch 322 is electrically connected to the control integrated circuit 312 and the first transistor switch 314. The second capacitor 324 is electrically connected to the number-setting circuit 302, the control integrated circuit 312, the first resistor 316, the first capacitor 318 and the voltage regulator 320. The diode 326 is electrically connected to the voltage regulator 320, the second capacitor 324 and the second transistor switch 322.

Figure 10:
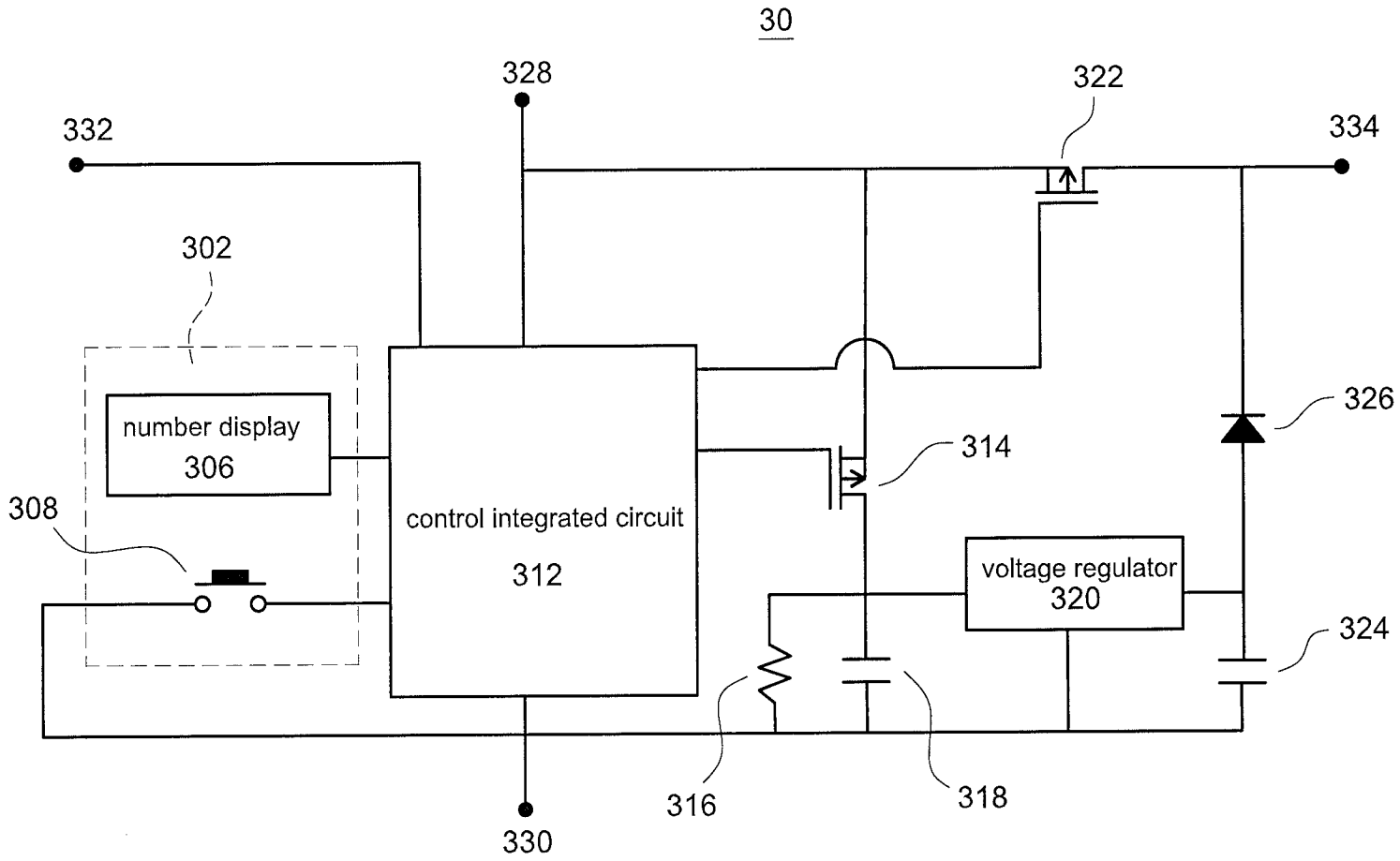
FIG. 10 shows a block diagram of the second embodiment of the parallel type data capture converter of the present invention.

FIG. 10 shows a block diagram of the second embodiment of the parallel type data capture converter of the present invention. FIG. 10 is applied to FIG. 3 and FIG. 5 (parallel type; the two-pin LED pixel-controlled light emitting diode lamps 504 are connected to each other in parallel through the power line 40). The description for the elements shown in FIG. 10, which are similar to those shown in FIG. 9, is not repeated here for brevity. The number-setting circuit 302 comprises a number display 306 and a button 308. The button 308 is electrically connected to the number display 306. The number of the data capture converter 30 is determined by a pressing count of the button 308 (for example, the button 308 has been pressed 2 times or 3 times etc.). The number display 306 displays the number of the data capture converter 30. The number display 306 is a seven-segment display.

Figure 11:
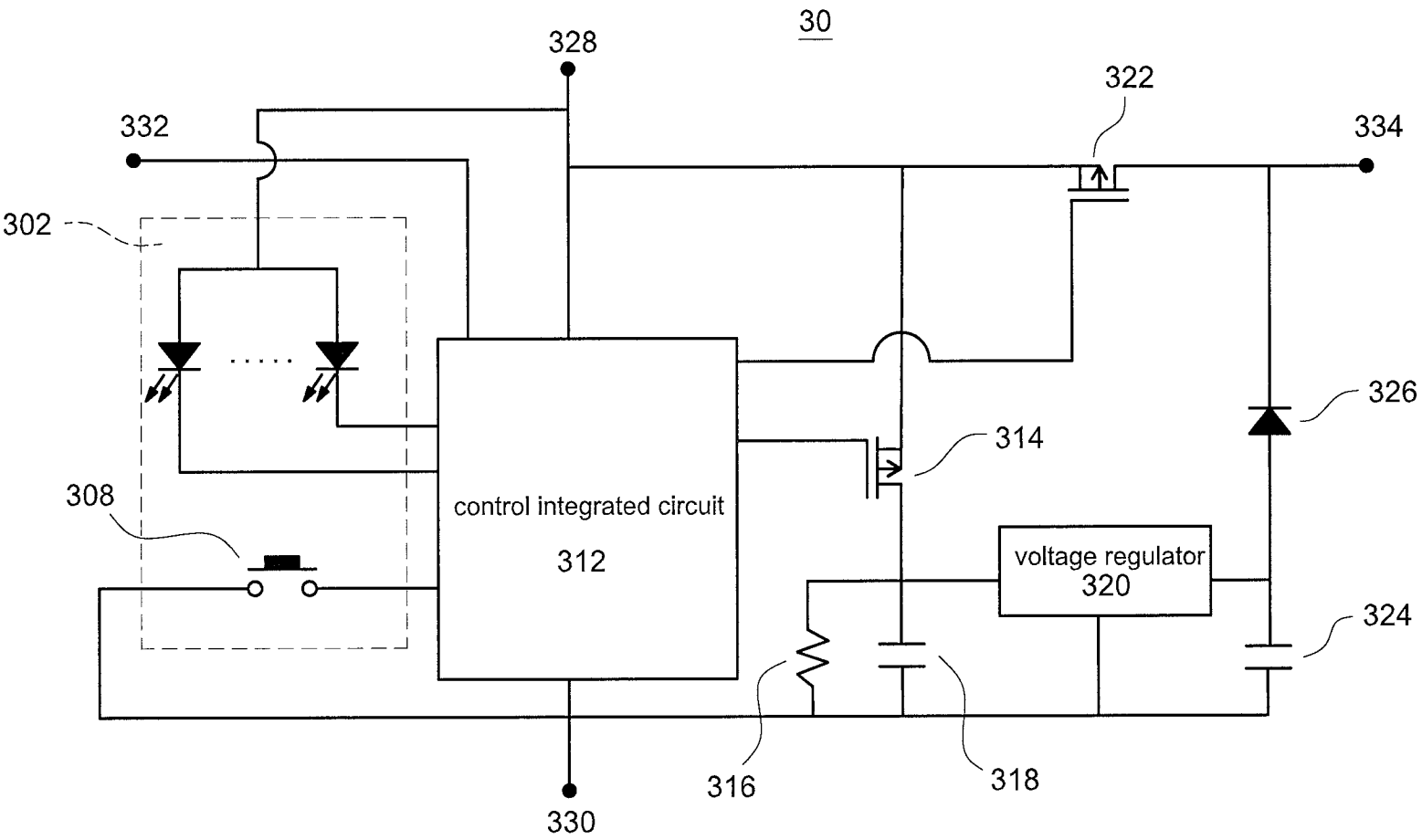
FIG. 11 shows a block diagram of the third embodiment of the parallel type data capture converter of the present invention.

FIG. 11 shows a block diagram of the third embodiment of the parallel type data capture converter of the present invention. FIG. 11 is applied to FIG. 3 and FIG. 5 (parallel type; the two-pin LED pixel-controlled light emitting diode lamps 504 are connected to each other in parallel through the power line 40). The description for the elements shown in FIG. 11, which are similar to those shown in FIG. 9, is not repeated here for brevity. The number-setting circuit 302 comprises a plurality of display lamps 310 and a button 308. The button 308 is electrically connected to the display lamps 310. The number of the data capture converter 30 is determined by a pressing count of the button 308 (for example, the button 308 has been pressed 2 times or 3 times etc.). The display lamps 310 display the number of the data capture converter 30. The display lamp 310 is a light emitting diode.

Figure 12:
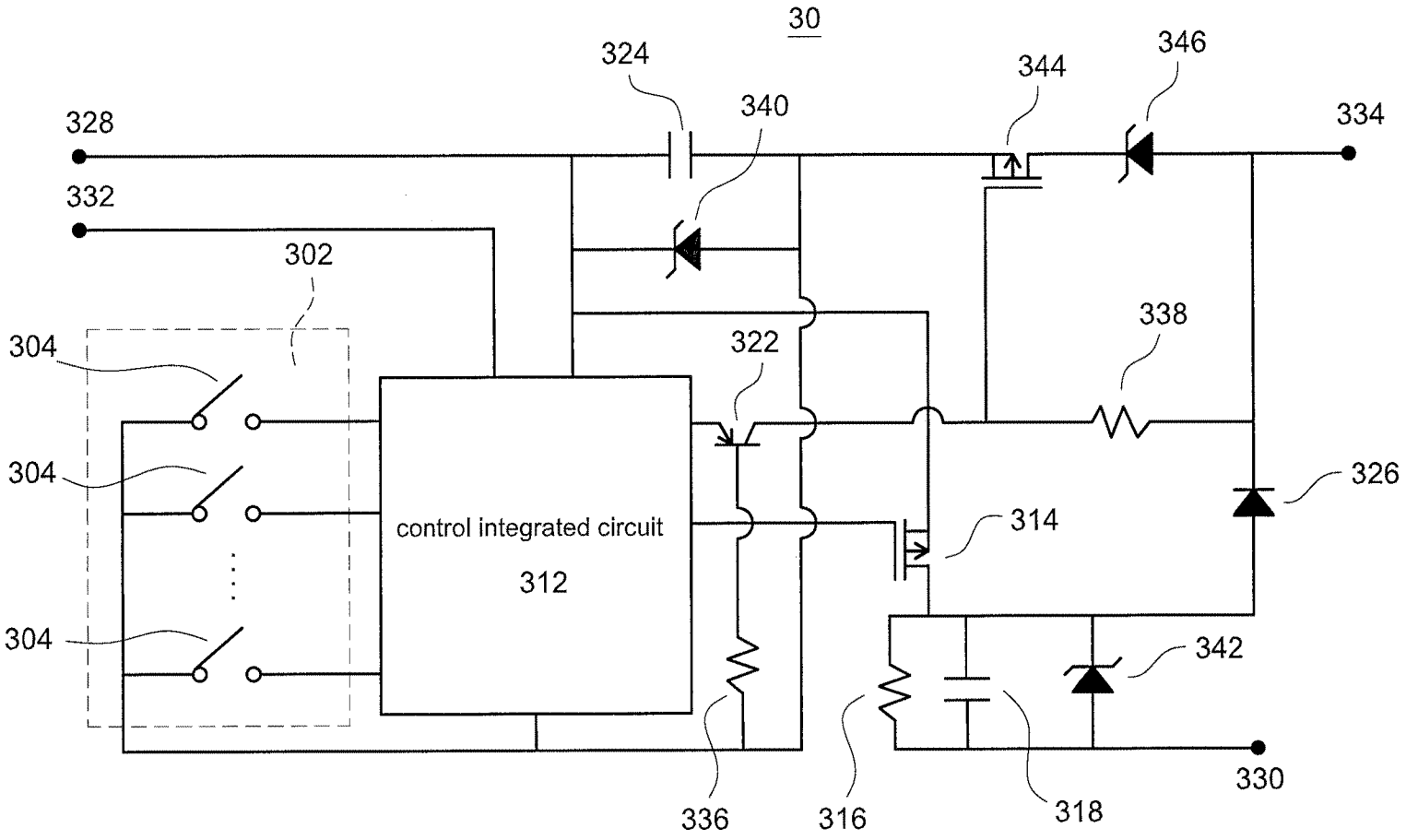
FIG. 12 shows a block diagram of the first embodiment of the serial type data capture converter of the present invention.

FIG. 12 shows a block diagram of the first embodiment of the serial type data capture converter of the present invention. FIG. 12 is applied to FIG. 2 and FIG. 4 (serial type; the two-pin LED pixel-controlled light emitting diode lamps 504 are connected to each other in series through the power line 40). The description for the elements shown in FIG. 12, which are similar to those shown in FIG. 9, is not repeated here for brevity.

The data capture converter 30 further comprises a control integrated circuit 312, a first transistor switch 314, a first resistor 316, a first capacitor 318, a second transistor switch 322, a second capacitor 324, a diode 326, a second resistor 336, a third resistor 338, a first Zener diode 340, a second Zener diode 342, a third transistor switch 344 and a third Zener diode 346. The control integrated circuit 312 is used to receive the picture signal 202 and generate the light signal 204.

The control integrated circuit 312 is electrically connected to the number-setting circuit 302. The first transistor switch 314 is electrically connected to the control integrated circuit 312. The first resistor 316 is electrically connected to the first transistor switch 314. The first capacitor 318 is electrically connected to the first transistor switch 314 and the first resistor 316. The second transistor switch 322 is electrically connected to the control integrated circuit 312. The second capacitor 324 is electrically connected to the number-setting circuit 302, the control integrated circuit 312 and the first transistor switch 314. The diode 326 is electrically connected to the first transistor switch 314, the first resistor 316 and the first capacitor 318. The second resistor 336 is electrically connected to the second transistor switch 322, the number-setting circuit 302, the control integrated circuit 312 and the second capacitor 324. The third resistor 338 is electrically connected to the diode 326 and the second transistor switch 322. The first Zener diode 340 is electrically connected to the number-setting circuit 302, the control integrated circuit 312, the second resistor 336, the second capacitor 324 and the first transistor switch 314. The second Zener diode 342 is electrically connected to the first transistor switch 314, the first resistor 316, the first capacitor 318 and the diode 326. The third transistor switch 344 is electrically connected to the number-setting circuit 302, the control integrated circuit 312, the second resistor 336, the second capacitor 324, the first Zener diode 340, the second transistor switch 322 and the third resistor 338. The third Zener diode 346 is electrically connected to the third transistor switch 344, the third resistor 338 and the diode 326. The third transistor switch 344 is a P-type metal-oxide-semiconductor field effect transistor (P-MOSFET).

Figure 13:
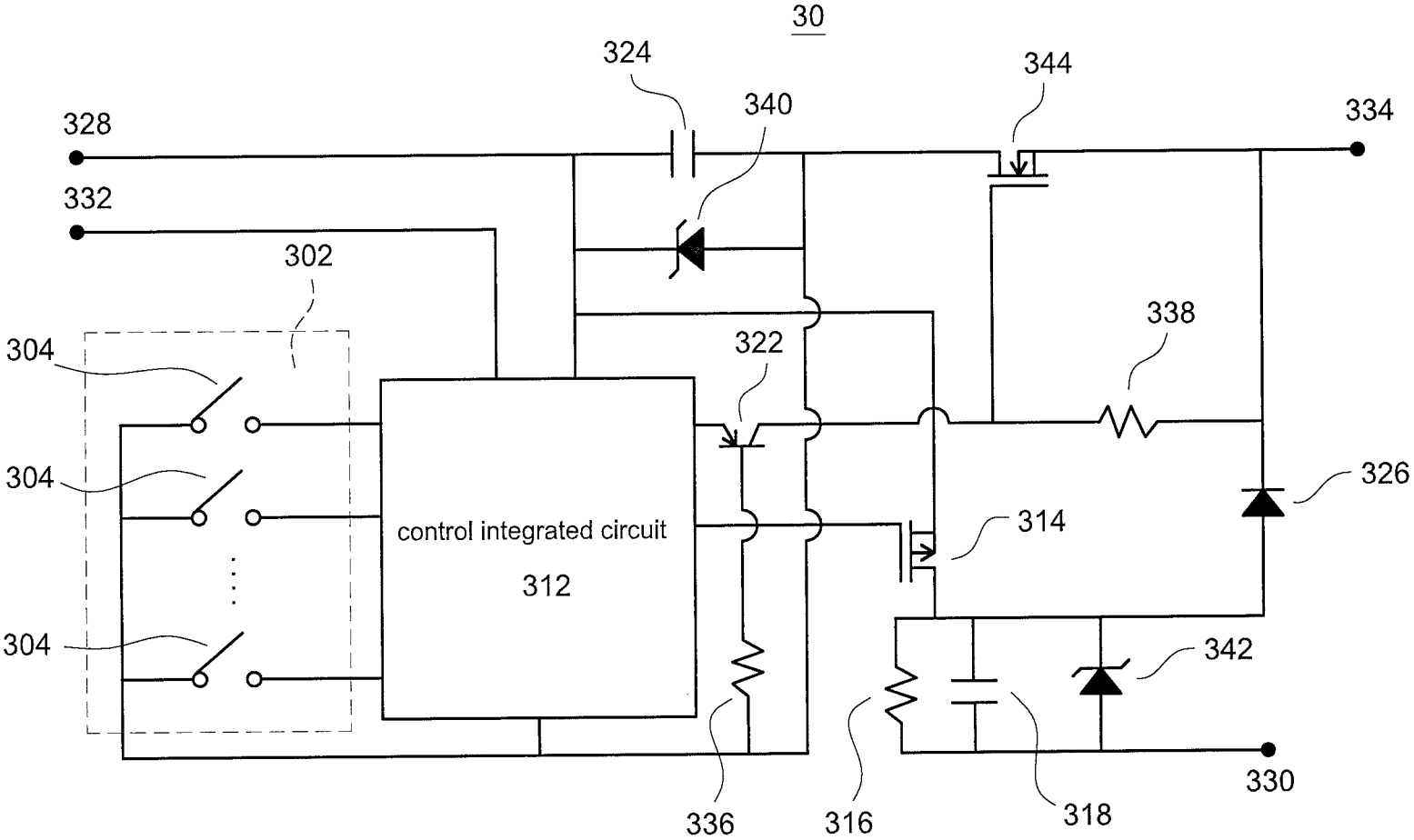
FIG. 13 shows a block diagram of the second embodiment of the serial type data capture converter of the present invention.

FIG. 13 shows a block diagram of the second embodiment of the serial type data capture converter of the present invention. FIG. 13 is applied to FIG. 2 and FIG. 4 (serial type; the two-pin LED pixel-controlled light emitting diode lamps 504 are connected to each other in series through the power line 40). The description for the elements shown in FIG. 13, which are similar to those shown in FIG. 12, is not repeated here for brevity. The data capture converter 30 further comprises a third transistor switch 344. The third transistor switch 344 is electrically connected to the number-setting circuit 302, the control integrated circuit 312, the second resistor 336, the second capacitor 324, the first Zener diode 340, the second transistor switch 322, the third resistor 338 and the diode 326. The third transistor switch 344 is an N-type metal-oxide-semiconductor field effect transistor (N-MOSFET).

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A two-pin LED pixel-controlled light string system comprising:

a controller;

a plurality of data capture converters, each of the data capture converters electrically connected to the controller respectively;

a plurality of power lines connected to the data capture converters; and a plurality of two-pin LED pixel-controlled light string sets connected to the power lines and electrically connected to the data capture converter respectively, wherein the data capture converter comprises:

a number-setting circuit, wherein the controller sends a picture signal to the data capture converters; each of the number-setting circuits is used to set a number of the data capture converter; according to the number, the data capture converter captures a captured part of the picture signal; the data capture converter converts the captured part of the picture signal to obtain a light signal; the data capture converter sends the light signal through the power line to the two-pin LED pixel-controlled light string set that the two-pin LED pixel-controlled light string set is in accordance with and electrically connected to the data capture converter, to drive the two-pin LED pixel-controlled light string set to light; each of the two-pin LED pixel-controlled light string sets lighting together forms a picture representing the picture signal.

2. The two-pin LED pixel-controlled light string system in claim 1, wherein the two-pin LED pixel-controlled light string set comprises:

a plurality of two-pin LED pixel-controlled light string electrically connected to the data capture converter through the power line, wherein the two-pin LED pixel-controlled light string comprises:

a plurality of two-pin LED pixel-controlled light emitting diode lamps electrically connected to the data capture converter through the power line, wherein the two-pin LED pixel-controlled light emitting diode lamp comprises an address code; the address codes of the two-pin LED pixel-controlled light emitting diode lamps of the two-pin LED pixel-controlled light string set are different; the address codes of the two-pin LED pixel-controlled light emitting diode lamps of the two-pin LED pixel-controlled light string set form an address code group; each of the two-pin LED pixel-controlled light string sets comprises the same address code group;

wherein the light signal comprises a plurality of signals with different address codes; the data capture converter sends the light signal through the power line to the two-pin LED pixel-controlled light emitting diode lamps of the two-pin LED pixel-controlled light strings of the two-pin LED pixel-controlled light string sets; according to the address code that the two-pin LED pixel-controlled light emitting diode lamp has, the two-pin LED pixel-controlled light emitting diode lamp reads the light signal and lights accordingly.

3. The two-pin LED pixel-controlled light string system in claim 1, wherein the number-setting circuit comprises:

a plurality of switches, wherein the number of the data capture converter is determined by a status of the switches.

4. The two-pin LED pixel-controlled light string system in claim 1, wherein the number-setting circuit comprises:

a number display; and a button electrically connected to the number display, wherein the number of the data capture converter is determined by a pressing count of the button; the number display displays the number of the data capture converter.

5. The two-pin LED pixel-controlled light string system in claim 1, wherein the number-setting circuit comprises:

a plurality of display lamps; and a button electrically connected to the display lamps, wherein the number of the data capture converter is determined by a pressing count of the button; the display lamps display the number of the data capture converter.

6. The two-pin LED pixel-controlled light string system in claim 2, wherein the data capture converter further comprises:

a control integrated circuit electrically connected to the number-setting circuit, the control integrated circuit receiving the picture signal and generating the light signal;

a first transistor switch electrically connected to the control integrated circuit;

a first resistor electrically connected to the number-setting circuit, the control integrated circuit and the first transistor switch;

a first capacitor electrically connected to the number-setting circuit, the control integrated circuit, the first transistor switch and the first resistor;

a voltage regulator electrically connected to the number-setting circuit, the control integrated circuit, the first transistor switch, the first resistor and the first capacitor;

a second transistor switch electrically connected to the control integrated circuit and the first transistor switch;

a second capacitor electrically connected to the number-setting circuit, the control integrated circuit, the first resistor, the first capacitor and the voltage regulator; and a diode electrically connected to the voltage regulator, the second capacitor and the second transistor switch.

7. The two-pin LED pixel-controlled light string system in claim 2, wherein the data capture converter further comprises:

a control integrated circuit electrically connected to the number-setting circuit, the control integrated circuit receiving the picture signal and generating the light signal;

a first transistor switch electrically connected to the control integrated circuit;

a first resistor electrically connected to the first transistor switch;

a first capacitor electrically connected to the first transistor switch and the first resistor;

a second transistor switch electrically connected to the control integrated circuit;

a second capacitor electrically connected to the number-setting circuit, the control integrated circuit and the first transistor switch;

a diode electrically connected to the first transistor switch, the first resistor and the first capacitor;

a second resistor electrically connected to the second transistor switch, the number-setting circuit, the control integrated circuit and the second capacitor;

a third resistor electrically connected to the diode and the second transistor switch;

a first zener diode electrically connected to the number-setting circuit, the control integrated circuit, the second resistor, the second capacitor and the first transistor switch; and a second zener diode electrically connected to the first transistor switch, the first resistor, the first capacitor and the diode.

8. The two-pin LED pixel-controlled light string system in claim 7, wherein the data capture converter further comprises:

a third transistor switch electrically connected to the number-setting circuit, the control integrated circuit, the second resistor, the second capacitor, the first zener diode, the second transistor switch and the third resistor; and a third zener diode electrically connected to the third transistor switch, the third resistor and the diode, wherein the third transistor switch is a p-type metal-oxide-semiconductor field effect transistor.

9. The two-pin LED pixel-controlled light string system in claim 7, wherein the data capture converter further comprises:

a third transistor switch electrically connected to the number-setting circuit, the control integrated circuit, the second resistor, the second capacitor, the first zener diode, the second transistor switch, the third resistor and the diode, wherein the third transistor switch is an n-type metal-oxide-semiconductor field effect transistor.

10. The two-pin LED pixel-controlled light string system in claim 1, wherein the picture signal comprises a plurality of pulse waves; the data capture converter counts the pulse waves of the picture signal received by the data capture converter; according to the number, the data capture converter captures the captured part of the picture signal; the captured part is captured according to the number and a counting value.

11. The two-pin LED pixel-controlled light string system in claim 1, wherein the data capture converter is integrated into the controller.

* * * * *